United States Patent [19]

Düringer

[11] Patent Number: 4,615,194

[45] Date of Patent: Oct. 7, 1986

[54] PERMUTATION LOCK

[75] Inventor: Rudi Düringer, Wuppertal, Fed. Rep. of Germany

[73] Assignee: S. Franzen Söhne (GmbH & Co.), Solingen, Fed. Rep. of Germany

[21] Appl. No.: 751,490

[22] Filed: Jun. 3, 1985

[30] Foreign Application Priority Data

Aug. 29, 1984 [DE] Fed. Rep. of Germany ..... 3431649

[51] Int. Cl.[4] ..... E05B 37/02

[52] U.S. Cl. ..... 70/312; 70/329

[58] Field of Search ..... 70/312, 311, 323, 326, 70/327, 328, 329

[56] References Cited

U.S. PATENT DOCUMENTS 4,279,136 7/1981 Milles ..... 70/71

4,343,163 8/1982 Scelba ..... 70/312

4,441,346 4/1984 Castiglioni ..... 70/312

FOREIGN PATENT DOCUMENTS 850409 9/1952 Fed. Rep. of Germany .

*Primary Examiner*—Robert L. Wolfe

*Attorney, Agent, or Firm*—Burns, Doane, Swecker & Mathis

[57] ABSTRACT

A permutation lock comprises a housing into which is inserted a frame. The frame carries an axle on which a plurality of individually rotatable dials are mounted. The axle is joined at one end to the frame and extends longitudinally therefrom in cantilever fashion such that an opposite end of the axle is free of the frame. The dials can be inserted onto the axle over that free end, and the unit comprising the frame and the assembled dials can then be inserted into the housing.

18 Claims, 9 Drawing Figures

FIG. 7
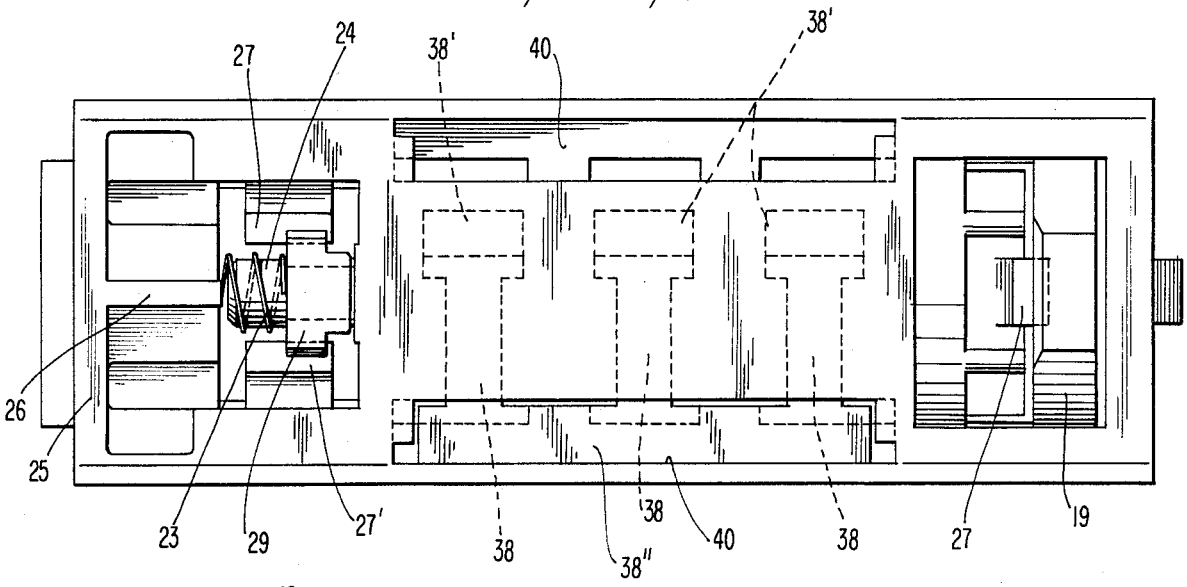
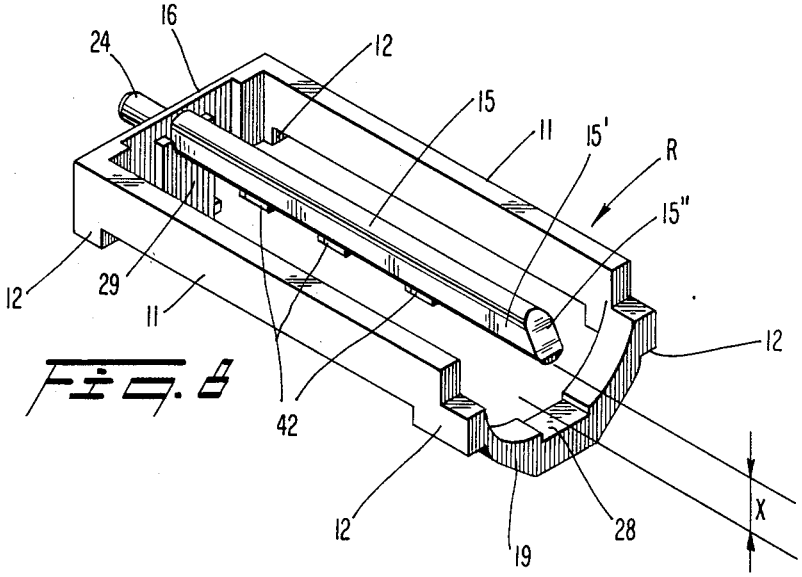
FIG. 8
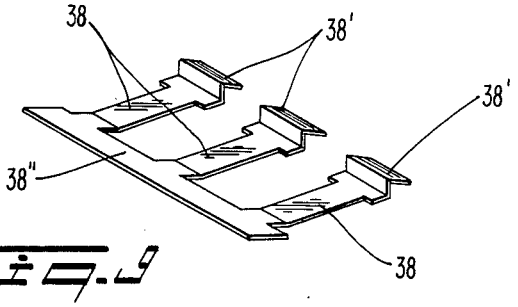
FIG. 9

PERMUTATION LOCK

RELATED INVENTION

The disclosure of copending application Ser. No. 751,489, filed July 3, 1985 (corresponding to German Application No. P 34 31 648.5 filed Aug. 29, 1984) which relates to a similar lock is hereby incorporated by referenced herein.

BACKGROUND AND OBJECTS OF THE INVENTION

The invention concerns a permutation lock of the type comprising a plurality of independently rotatable dials arranged on an axle. The axle is mounted on a movable frame which is moved in the direction of the axle axis in response to manual actuation.

In German No. DE-P 850 409 there is disclosed a permutation lock in which the axle carrying the dials is associated with a frame. Both ends of the axle are secured to the frame. The dials thus must be inserted onto the axle prior to the joining of the latter to the frame. The mounting of the axle onto the frame is thereby hindered by the presence of the dials and is too expensive for mass production.

It is an object of the invention to simplify a permutation lock of this generic type with regard to its assembly, and provide it with a compact configuration that is stable in use.

SUMMARY OF THE INVENTION

These objects are attained by the present invention which includes a frame having a leg to which one end of the axle is joined. The axle extends longitudinally from the leg in cantilever fashion such that an opposite end of the axle is free of the frame. Dials are slid onto the axle over the free end, and the assembly of the frame, axle and dials is inserted into a housing.

Preferably, the free end of the axle is positioned against a surface of the housing when the frame is inserted into the housing.

Preferably, the housing includes tongues which are cammed out during insertion of the frame and which snap-back to clamp the frame within the housing.

Preferably, the axle comprises an integrally molded part of the frame.

By means of this configuration, a permutation lock of the afore-described generic type, with a simplified structure and easier assembly operation is created. Because the axle has a free end, assemblage of the frame and dials can be achieved quickly and easily. This is an advantage not only in manual assembly work, where the frame is available in the form of a stable, relatively large gripping part, but correspondingly also in the case of automatic assembly. It is advantageous that the free end of the axle terminates at a distance from another leg of the frame located opposite the leg to which the one end of the axle is fastened. This provides a sufficiently free coordinating area for the controlled insertion of the dials, etc. In an advantageous manner, the distance between the free end of the axle and the transverse leg of the frame may be obtained by shaping the other leg as an arc, with the distance from the line of the arc to the free end of the axle corresponding to at least the radius of the dials.

The legs of the frame can be guided on lateral shoulders of the housing in a longitudinally displaceable manner. Advantageously, lateral guide surfaces of the frame can be formed by projections of the longitudinal legs of the frame. The clamping of the frame to the housing may be produced simply by locating clamp tongues of the housing adjacent the arc-shaped transverse leg and a T-shaped downward pointing foot of the other leg.

The leg to which the axle is joined can carry a peg for the reception of a compression spring biasing the frame. The free end of the axle may engage a depression in a transverse wall of an insert part of the lock housing, while a second compression spring seated on the axle rests against such transverse wall and serves to bias the locking sleeves in their engaging position in relation to the dials. A fork of an external actuating handle may straddle the axle between the transverse leg carrying the axle and the frontal end of the outermost locking sleeve.

BRIEF DESCRIPTION OF THE DRAWINGS

The objects and advantages of the invention will become apparent from the following detailed description of a preferred embodiment thereof in connection with the accompanying drawings in which like numerals designate like elements, and in which:

FIG. 7 is a rear view of the permutation lock with the front plate (not shown) and the protective shape removed;

FIG. 8 is a perspective view of the frame; and

FIG. 9 is a perspective view of a dial spring.

DETAILED DESCRIPTION OF A PREFERRED EMBODIMENT OF THE INVENTION

Figure 1:
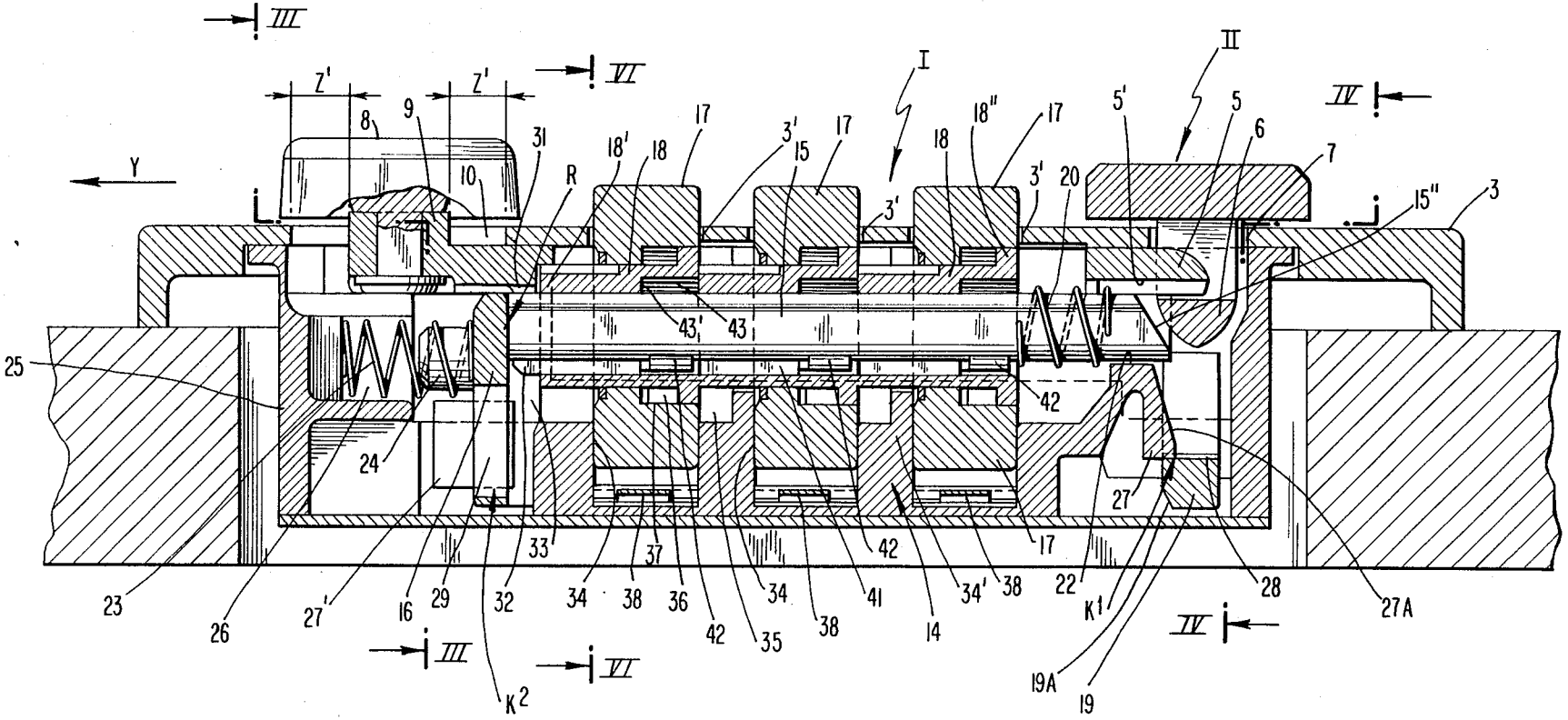
FIG. 1 is a longitudinal section through a permutation lock according to the present invention, the section being along the axle.

A permutation lock according to the present invention comprises a permutation lock part I and a locking hasp part forming a counter lock part II.

The permutation lock part I is closed-off at the front by a plate 3. Behind the plate 3 an actuating slide 4 is located which is longitudinally displaceable against the action of a spring 23 as will be hereafter explained. A suitable stop limits the extent of longitudinal movement. The actuating slide 4 carries on its end facing the hasp, a locking projection 5 which engages a lug 6 of the hasp in a locking manner. The front plate 3 has an opening 7 for the passage of the lug 6.

In a terminal end of the actuating slide 4 remote from the hasp, a forwardly extending actuating handle 8 leading to the outside is located. The handle 8 includes a shaft 9 which projects through a window 10 of the front plate 3.

Figure 2:
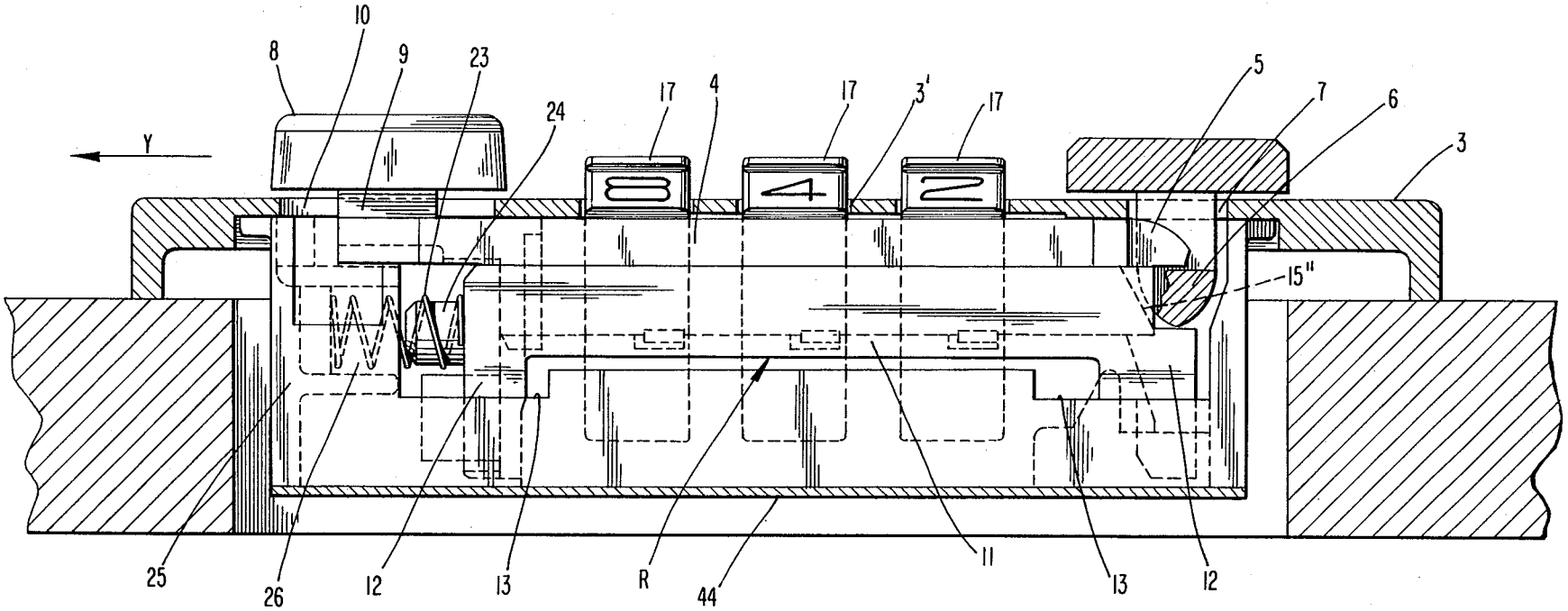
FIG. 2 is a longitudinal section taken along a plane spaced from the axle.
Figure 3:
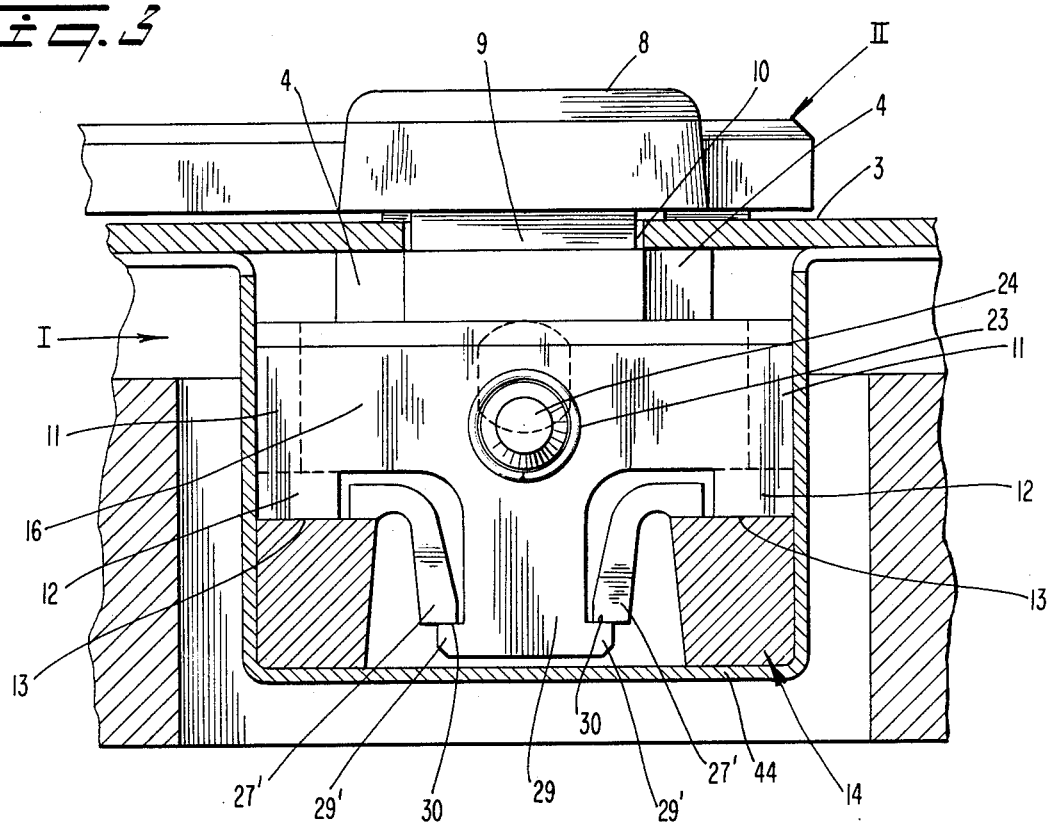
FIG. 3 is a cross-section taken along the line III—III in FIG. 1 in a view enlarged with respect to FIG. 1.

The actuating slide 4 is displaceable in a plane disposed parallel to the front plate and is arranged to engage a frame R which is also displaceable longitudinally and which is limited by a suitable stop. The frame R, which is best shown in FIG. 8, includes rearwardly extending projections 12. The projections 12 are guided on lateral shoulders 13 of an insert part 14 of the lock housing (FIGS. 2 and 3). The projections 12 have a relatively small surface area and are located at corner regions of the frame R.

An axle 15 is molded integrally with the frame R and of the same material. The axle 15 commences at the transverse leg 16 adjacent the actuating handle and supports a plurality of locking sleeves 18 carrying the dials 17 arranged in a row.

To facilitate the threading of these parts, the axle 15 is free of the frame at its end 15' located opposite the transverse leg 16. That is, the axle is affixed to the frame R at only one end and extends in cantilever fashion from such end. The axle 15 extends as far as the transverse leg 19, but terminates at a radial distance x from the leg 19 (FIG. 8). This spacing x between the free-floating end 15' of the axle 15 and the transverse leg 19 of the frame R occurs along the entire extent of the leg 19 due to an arc-like configuration of the leg 19, the concave side of the arc arranged to face the shaft. The distance x from the line of the arc (i.e., the inner or concave surface of the transverse leg 19 facing the axle 15) to the free end 15' corresponds at least to the radius of the dials 17. The insertion onto the axle of the locking sleeves 18 carrying the dials 17 is facilitated by a beveled frontal surface 15'' of the axle, as in this manner a taper (similar to that on a cannula) is obtained. The beveling further defines a portion of an entry space for the lug 16 of the counter lock part II (FIG. 1), thereby producing a very compact overall configuration. The annular dials 17 protrude partially through the orifices 3' of the front plate 3 so as to be manipulable from the outside.

Figure 5:
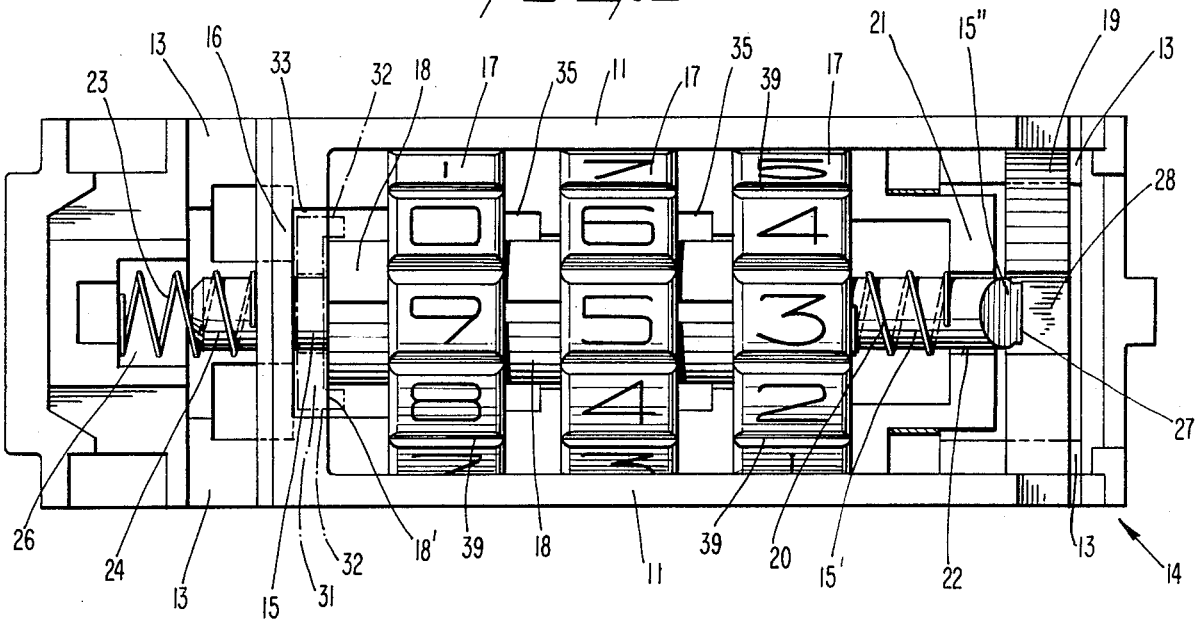
FIG. 5 is a front view of the permutation lock with the front plate eliminated.

A compression spring 20 is placed on the hasp side 15' of the axle 15. The spring 20 has an outwardly directed terminal spring coil which rests against a transverse wall 21 of the insert part 14 of the locking housing, while the opposite terminal spring coil biases the locking sleeves 18 in a direction effecting a coupling engagement with the dials 17. The transverse wall 21 includes a depression 22 which opens toward the front plate and in which the free-floating end 15'' of the axle 15 is resting (FIGS. 1 and 5). In order to obtain adequate free space for the compression spring 20, the rear side of the locking projection 5 has a recess 5' which forms a part of the spring chamber.

A compression spring 23 biases frame R toward locking engagement with the lug 6 of the hasp. This compression spring 23 is seated on a peg 24 which extends from an outer surface of the transverse leg 16. The peg 24 is molded onto the leg 16 and has an axis which is slightly offset from the axis of the axle 15 in a rearward direction. The compression spring 23 is also supported on a side of the housing, specifically against a transverse wall 25 of the insert part 14 of the lock housing. The wall 25 forms a forwardly (radially) open spring insertion chamber 26.

This configuration and the depression 22 which opens forwardly toward the front plate 3, make it possible to insert the preassembled locking unit of the frame R, dials 17, sleeves 18, springs 20, 23 rearwardly (transversely) into the insert 14 of the lock housing. In so doing, the dials 17 enter slots formed between spaced walls 34' of the insert part 14. The actuating slide 4 is subsequently mounted.

To secure the countersunk coordinated position of the locking unit and its secret code resetting device, the unit is clamped against the insert part 14 at clamping locations K1, K2 in the area of the transverse legs 16 and 19.

Figure 4:
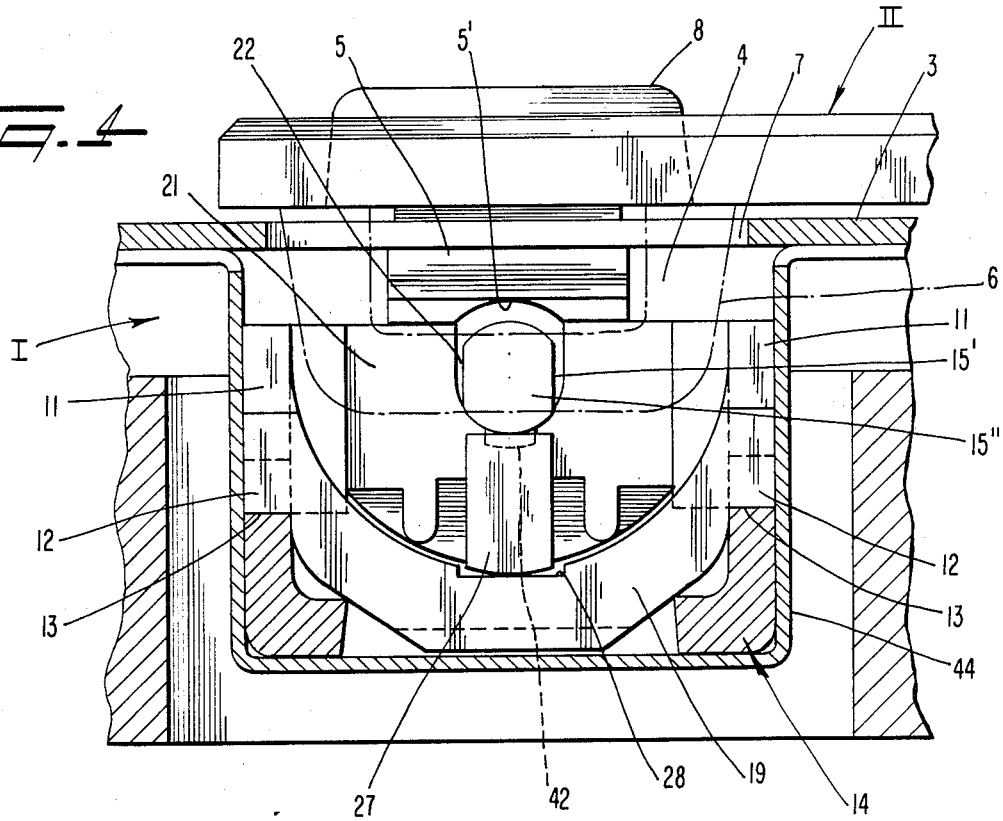
FIG. 4 is a cross-section taken along the line IV—IV in FIG. 1.

At the clamping location K1, a rearwardly projecting tongue 27 (clamping projection) of the insert part 14 presses against the arc-shaped transverse leg 19. The tongue 27 is received in a flattened longitudinal groove 28 of the leg 19 (FIG. 4). To facilitate the insertion of the leg 19 rearwardly past the tongue 27, an end surface 27A of the tongue is chamfered and a rear side of the wall 19 is correspondingly beveled at 19A. Thus, the wall 19 cams (flexes) the tongue (to the left as viewed in FIG. 1) as the frame R is inserted into the insert 14. The width of the transverse leg at the groove 28 is made long enough to accommodate the opening-actuating stroke of the locking slide 4 plus the frame R so that the tongue 27 stays in contact with the leg 19.

At the clamping location K2, a T-shaped rearwardly directed foot 29 of the frame R extends from the leg 16. A plane bisecting that foot 29 also includes the axle 15. The foot 29 includes ears 29' which are arranged to be engaged by tongues 27' formed as part of the insert part 14 of the lock housing. The tongues 27' converge toward the rear of the housing, so that bevels 27'A are present on the tongues 27' that are engaged by bevels 29'A on the ears to flex the tongues 27' as the frame R is inserted into the insert 14. The symmetrically located clamping shoulders 30 of the ears 29' are of such a length that the tongues 27' remain in contact with the ears 29' even during longitudinal displacement of the frame R.

Conveniently, the frame comprises a die cast metal part and the insert comprises an injection molded synethetic plastic part.

When displacing the actuating slide 4 in a direction Y for retracting the locking projection 5 (which is possible only when set in a "combination mode") the frame R is displaced against spring action (compression spring 23), by means of a fork 31 which extends rearwardly from a backside of the actuating slide 4 (FIGS. 1, 5). Prongs 32 of the fork 31 straddle the axle 15. For the entry of the fork 31 a receiving space 33 is provided between an inner side of the transverse leg 16 and a frontal end 18' of the outermost locking sleeve 18. Thus, actuation of the slide in the direction Y also displaces the frame R in that direction. The window 10 comprises in this direction, a free space z' corresponding to the stroke length.

Alteration of the secret code is possible, but only when the dials are set in an "on combination" mode. Alteration is effected by the extraction of the locking sleeves 18 from the dials 17 as the manual handle 8 is pushed in a direction opposite the direction Y. A free space z'' is provided to accommodate such movement of the handle 8. In the process, the frame R remains in its base (rest) position, while the locking sleeves 18 are displaced to the necessary extent. The slots 34 of the insert 14 which receive the dials 17 include escape spaces 35 required for the extraction of the locking sleeves 18, with the collars 18'' of the locking sleeves entering such spaces 35, together with the coupling projections 36 provided on the collar side. In most cases four such coupling projections are provided and they cooperate with a total of ten recesses 37 of the dial arranged at equal angles. In order for the locking sleeves 18 to be pushed back to the left by the spring 20, the coupling projections 36 and recesses 37 must be mutually aligned. Also, in the absence of such alignment, the locking projection 5 cannot be guided back through the lug 6 because the locking sleeve 18 protruding on the hasp side blocks the projection 5 from movement.

Figure 6:
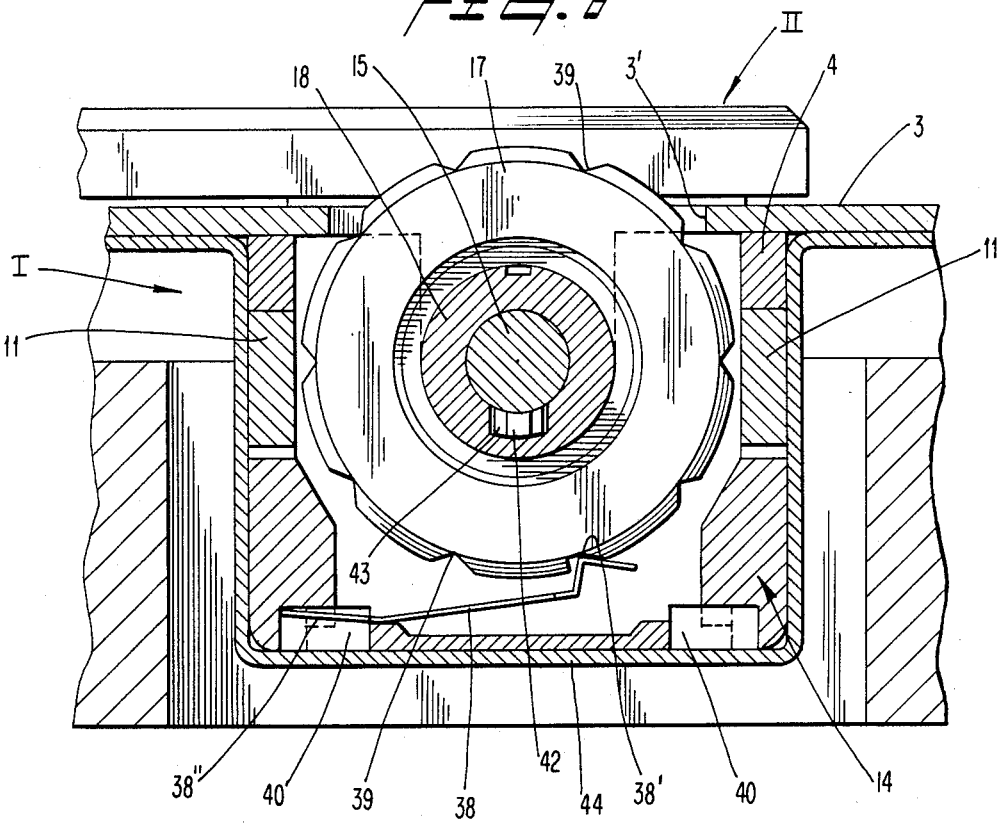
FIG. 6 is a cross-section taken along the line VI—VI in FIG. 1.

The prevailing angular positions of the dials 17 together with the locking sleeves 18 are yieldably secured by locking springs 38 (FIG. 9), which have locking heads 38' that enter notch-like locking recesses 39 distributed equiangularly over the circumference of the dials 17 in keeping with the decimal division (FIG. 6). In the preferred embodiment the individual locking springs are provided in the form of a comb-like stamping. A back ledge 38'' of the comb is inserted in a longitudinal recess 40 on the bottom side of the insert 14. The individual locking springs originating in the ledge 38'' pass through an opening between the insert space and the recess 40, in order to enter with their widened, twice-angled ends the locking recesses in the manner of cams.

To open the lock, a knowledge of the secret code is required. An authorized user must set the dials 17 so that longitudinally directed locking recesses 41 of the locking sleeves 18 are aligned with locking projections 42 on a side of the axle 15. The projections 42 extend in a row successively to each other. If the correct pattern is present, the frame R carrying the axle 15 may be displaced together with the actuating slide 4 by moving the actuating handle 8 in the direction Y. The hasp is then released. If, on the other hand, one of the locking sleeves 18 had been rotated by means of the dial 17 (provided with digital symbols on its circumference), the opening movement will be blocked, because a frontal end 42' of the locking projection 42 facing away from the locking projection 5 bears against an annular shoulder 43' of an annular free space 43 of the locking sleeve 18, which space 43 opens toward the locking projection 5.

The insert part of the lock housing is positioned in a sheet metal part 44 with a U-shaped cross-section, which protectively surrounds the lateral walls and bottom of the insert part as well as the lateral sections of the frame.

It will be appreciated from the foregoing that the frame R along with its axle 15 can be formed prior to the mounting of the dials and sleeves. This results from the cantilever arrangement of the axle which enables the dials and sleeves to be inserted onto the free end of the axle. Thus, the lock can be produced less expensively.

Although the present invention has been described in connection with a preferred embodiment thereof, it will be appreciated by those skilled in the art that additions, modifications, substitutions, and deletions not specifically described, may be made without departing from the spirit and scope of the invention as defined in the appended claims.

What is claimed is:

1. A permutation lock of the type comprising a housing in which a plurality of dials and associated locking sleeves are mounted for rotation upon a longitudinally extending axle, said locking sleeves and axle forming cooperating recesses and locking projections which, when longitudinally aligned with one another, permit said axle to be moved longitudinally relative to said housing and dials in an unlocking stroke against a spring bias, the improvement wherein:

a frame is mounted in said housing so as to be movable longitudinally relative to said housing, said axle having one end joined to said frame and extending longitudinally therefrom in cantilever fashion such that an opposite end of said axle is free of said frame.

2. A permutation lock according to claim 1, wherein said frame includes a first leg extending transversely relative to the axis of said axle, said axle being joined to said first leg, said frame including a second transverse leg situated adjacent said opposite end of said axle and being spaced from said opposite end by a pre-set distance in a direction disposed transversely relative to said axis.

3. A permutation lock according to claim 2, wherein said second leg forms an arc which is spaced by said distance from said opposite end of said axle, said distance being at least as large as the radius of such dials.

4. A permutation lock according to claim 1, wherein said axle comprises an integrally molded part of said frame.

5. A permutation lock according to claim 4, wherein said axle is formed of the same material as the rest of said frame.

6. A permutation lock according to claim 1, wherein said housing includes an insert part having a plurality of shoulders upon which said first and second legs of said frame are slidably resting.

7. A permutation lock according to claim 6, wherein said insert part includes a plurality of tongues which press against portions of said frame to retain said frame in said insert part.

8. A permutation lock according to claim 7, wherein said first and second legs of said frame include a plurality of projections which rest against said shoulders.

9. A permutation lock according to claim 7, wherein said housing includes a first leg to which said axle is joined, and a second leg disposed adjacent said opposite end of said axle, said tongues engaging said first and second legs.

10. A permutation lock according to claim 9, wherein said tongues are resiliently flexible so as to be cammed out by said legs when said frame is inserted into said housing.

11. A permutation lock according to claim 1, wherein said opposite end of said axle slidably rests against a wall portion of said housing.

12. A permutation lock according to claim 11, wherein said frame includes a leg having opposed surfaces, said axle joined to one of said surfaces, said leg including a peg extending from the other of said surfaces, a first compression spring mounted on said peg to yieldably bias said frame to a normal position relative to said housing, and a second compression spring acting between said locking sleeves and said wall portion of said housing to yieldably bias said locking sleeves against said dials.

13. A permutation lock according to claim 11 including an actuating handle accessible to manual actuation, a fork being joined to said handle and arranged to engage said frame to move the latter in an unlocking stroke.

14. A permutation lock according to claim 13, including an actuating slide to which said handle and fork are joined, said dials projecting through said slide, said slide being longitudinally slidable relative to said dials and carrying a locking projection to lockingly interengage a member to be locked.

15. A locking unit for insertion into a housing of a permutation lock, said lock being of the type in which a plurality of individually rotatable dials are rotated to a predetermined relationship to effect an unlocking of a slide, said locking unit comprising:

a frame having a leg and an axle joined at one end to said leg and extending longitudinally therefrom in cantilever fashion such that an opposite end of said axle is free of said frame to enable the discs to be inserted onto said axle.

16. A permutation lock according to claim 15, wherein said frame and said axle are of one-piece molded construction.

17. A method of assembling a permutation lock of the type comprising a housing in which a frame is movably mounted, said frame carrying a plurality of dials and associated sleeves which are mounted for rotation upon a longitudinally extending axle, said locking sleeves and axle forming cooperating recesses and locking projections which, when longitudinally aligned with one another, permit said frame and axle to be moved longitudinally relative to said housing and dials in an unlocking stroke against a spring bias, said method comprising the steps of:

providing said frame with one end of said axle joined thereto and extending longitudinally therefrom in cantilever fashion such that an opposite end of said axle is free of said frame, sliding said dials onto said axle over said free end, and inserting said frame and said inserted dials into said housing.

18. A method according to claim 17, wherein said inserting step includes positioning said free end of said axle against a surface of said housing.

* * * * *